US008347969B2

(12) United States Patent
Orr et al.

(10) Patent No.: US 8,347,969 B2
(45) Date of Patent: Jan. 8, 2013

(54) APPARATUS AND METHOD FOR COMPENSATING FOR PRESSURE CHANGES WITHIN AN ISOLATED ANNULAR SPACE OF A WELLBORE

(75) Inventors: Benjamin R. Orr, Midlothian, TX (US); Edward T. Wood, Kingwood, TX (US); Aubrey C. Mills, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 323 days.

(21) Appl. No.: 12/925,307

(22) Filed: Oct. 19, 2010

(65) Prior Publication Data

US 2012/0090852 A1 Apr. 19, 2012

(51) Int. Cl.
*E21B 34/06* (2006.01)

(52) U.S. Cl. ..... 166/373; 166/316

(58) Field of Classification Search ..... 166/163, 166/164, 316, 324, 373
See application file for complete search history.

(56) References Cited

U.S. PATENT DOCUMENTS

| | | | | |
|---|---|---|---|---|
| 3,527,297 | A | 9/1970 | Todd | |
| 3,633,671 | A | 1/1972 | Nelson | |
| 4,260,017 | A | 4/1981 | Nelson et al. | |
| 4,729,430 | A | 3/1988 | White et al. | |
| 4,936,383 | A | 6/1990 | Towner et al. | |
| 5,020,600 | A | 6/1991 | Coronado | |
| 5,024,273 | A | 6/1991 | Coone et al. | |
| 5,048,611 | A | 9/1991 | Cochran | |
| 5,174,379 | A | 12/1992 | Whiteley et al. | |
| 5,860,452 | A | 1/1999 | Ellis | |
| 6,092,611 | A | 7/2000 | Saxman | |
| 6,109,356 | A * | 8/2000 | Echols et al. | 166/386 |
| 6,155,342 | A | 12/2000 | Oneal | |
| 6,186,236 | B1 | 2/2001 | Cox | |
| 6,216,785 | B1 | 4/2001 | Achee, Jr. et al. | |
| 6,253,861 | B1 | 7/2001 | Carmichael et al. | |
| 6,431,291 | B1 | 8/2002 | Moore et al. | |
| 6,571,875 | B2 | 6/2003 | Bissonnette et al. | |
| 6,973,978 | B2 | 12/2005 | Cravatte | |
| 7,011,153 | B2 | 3/2006 | Erkol | |

(Continued)

FOREIGN PATENT DOCUMENTS

EP 0207785 A2 1/1987

(Continued)

OTHER PUBLICATIONS

E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.

(Continued)

*Primary Examiner* — William P Neuder
(74) *Attorney, Agent, or Firm* — Greenberg Traurig LLP; Anthony F. Matheny

(57) ABSTRACT

Pressure relief devices comprise a chamber having a piston disposed therein. One side of the piston defines a hydrostatic chamber in fluid communication with an outside environment, such as an isolated wellbore annulus, through a port. The other side of the piston defines a sealed or isolated chamber. The pressure relief device permits changes in pressure in the isolated wellbore annulus to be distributed into the chambers so as to either reduce the pressure within the isolated wellbore annulus or increase the pressure within the wellbore annulus, both of which lessen the likelihood that the change in pressure within the isolated wellbore annulus will damage wellbore components disposed therein.

21 Claims, 7 Drawing Sheets

U.S. PATENT DOCUMENTS

| | | | | |
|---|---|---|---|---|
| 7,066,264 | B2 | 6/2006 | Bissonnette et al. | |
| 7,108,015 | B2 | 9/2006 | Lombari et al. | |
| 7,147,052 | B2 | 12/2006 | Erkol | |
| 7,353,845 | B2 | 4/2008 | Underwood et al. | |
| 7,500,526 | B2 | 3/2009 | Telfer | |
| 7,503,384 | B2 | 3/2009 | Coronado | |
| 7,628,213 | B2 | 12/2009 | Telfer | |
| 7,661,478 | B2 | 2/2010 | Palmer et al. | |
| 7,665,545 | B2 | 2/2010 | Telfer | |
| 7,762,324 | B2 | 7/2010 | Clem | |
| 7,861,744 | B2 | 1/2011 | Fly et al. | |
| 8,066,074 | B2 * | 11/2011 | Maskos et al. | 166/324 |
| 2003/0141059 | A1 | 7/2003 | Mauldin et al. | |
| 2004/0094304 | A1 | 5/2004 | Turner et al. | |
| 2004/0159447 | A1 | 8/2004 | Bissonnette et al. | |
| 2005/0279501 | A1 | 12/2005 | Surjaatmadja et al. | |
| 2006/0191685 | A1 | 8/2006 | Coronado | |
| 2007/0012458 | A1 | 1/2007 | Jackson | |
| 2007/0240883 | A1 | 10/2007 | Telfer | |
| 2008/0093080 | A1 | 4/2008 | Palmer et al. | |
| 2009/0056952 | A1 | 3/2009 | Churchill | |
| 2009/0139718 | A1 | 6/2009 | Clem | |
| 2009/0139720 | A1 | 6/2009 | Frazier | |
| 2010/0032162 | A1 | 2/2010 | Olstad et al. | |
| 2010/0181080 | A1 | 7/2010 | Levy | |
| 2010/0270030 | A1 | 10/2010 | Ashy et al. | |
| 2010/0319927 | A1 | 12/2010 | Yokley et al. | |
| 2010/0326737 | A1 | 12/2010 | Peddle et al. | |

FOREIGN PATENT DOCUMENTS

| | | | |
|---|---|---|---|
| WO | WO/0188328 | A1 | 11/2001 |

OTHER PUBLICATIONS

Henry Restarick, Horizontal Completion Options in Reservoirs With Sand Problems, Mar. 11, 1995, pp. 545-560, SPE 29831, Society of Petroleum Engineers, Inc., U.S.A.

E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.

Stephen P. Mathis, Sand Management: A Review of Approaches and Concerns, May 13, 2003, pp. 1-7, SPE 82240, Society of Petroleum Engineers Inc., U.S.A.

Nicholas J. Clem, et al., Utilizing Computational Fluid Dynamics (CFD) Analysis as a Design Tool in Frac Packing Application to Improve Erosion Life, SPE Annual Technical Conference and Exhibition, Sep. 24-27, 2006, SPE 102209, Society of Petroleum Engineers, San Antonio, Texas, USA.

Single-Action Bypass Sub brochure, 2007, p. 1, Mi Swaco, U.S.A.

Single-Action Bypass Sub Jetting Tool brochure, 2007, p. 1, Mi Swaco, U.S.A.

Dennis Denney, Pipe-Rotation Effect on Hole Cleaning for Water-Based Drilling Fluids in Horizontal and Deviated Wells, Journal of Petroleum Technology, Nov. 2008, pp. 65-66, 68; Society of Petroleum Engineers; USA.

B. Bloys, et al., Trapped Annular Pressure—A Spacer Fluid That Shrinks, Feb. 20, 2007, pp. 1-10, SPE/IADC 104698, SPE/IADC Drilling Conference, SPE, U.S.A.

B. Bloys, et al., Trapped Annular Pressure Migration: A Spacer Fluid that Shrinks—(Updated), Mar. 4, 2008, pp. 1-15, IADC/SPE 112872, IADC/SPE Drilling Conference, IADC/SPE, U.S.A.

* cited by examiner

APPARATUS AND METHOD FOR COMPENSATING FOR PRESSURE CHANGES WITHIN AN ISOLATED ANNULAR SPACE OF A WELLBORE

BACKGROUND

1. Field of Invention

The invention is directed to pressure relief devices for compensating for pressure changes within sealed or isolated zones of an annulus of an oil or gas wellbore.

2. Description of Art

Sealing or isolating zones or areas of an annulus of wellbores is well known in the art. In general, one or more wellbore barriers such as packers or bridge plugs are disposed with in a wellbore above and below a "zone" or area of the wellbore in which production, or other wellbore intervention operations are performed. In some instances, the isolated zone is not being produced or intervention operations are not being performed, however, tubing, e.g., an inner casing, is disposed through this zone so that oil or gas production or other downhole operations can be performed below the isolated zone. In these instances, the fluid trapped or sealed in this isolated zone can expand or contract depending on the temperature of the fluid trapped in the isolated zone. When the temperature increases, such as during production from other zones within in the wellbore, the fluid expands and can cause damage to the inner casing of the wellbore, the outer casing of the wellbore, other components within the wellbore, or the formation itself. When the temperature decreases, such as when fluid is pumped or injected into the wellbore, the fluid contracts and can cause damage to the inner casing of the wellbore, the outer casing of the wellbore, other components within the wellbore, or the formation itself.

SUMMARY OF INVENTION

In situations where wells are designed with multiple barriers, such as packers, bridge plugs and the like, in the annular space, fluid becomes trapped in the space between these barriers. If the temperature of this trapped fluid increases, such as during production from the well, pressure within this isolated annular space increases. If the temperature of this trapped fluid decreases, such as during injection of fluids into the well, pressure within this isolated annular space decreases. In some situations, these pressure changes can be substantial and may cause failure of critical well components, including damage to the formation itself.

The pressure relief devices disclosed herein facilitate compensation of the pressure within the isolated wellbore annulus. Broadly, the pressure relief devices disclosed herein comprise a tubular member having a housing disposed on an outer wall surface of the tubular member. The housing comprises a chamber divided into two portions by a piston. One portion of the chamber, referred to as the hydrostatic chamber, is in fluid communication with the wellbore environment through a port. The other portion of the chamber, referred to as the sealed chamber, is sealed and may be at atmospheric pressure or it may have a gas disposed therein. As pressure within the outside environment, such as within an isolated wellbore annulus, increases such as due to an increase in temperature within that environment, the resultant increase in pressure is distributed through the port and into the hydrostatic chamber. As pressure within the outside environment decreases, such as due to a decrease in temperature within that environment, the resultant decrease in pressure is compensated by pressure moving through the port and into the outside environment. As a result, the likelihood that the change in pressure within the outside environment will cause damage to the wellbore or the tubing disposed within the wellbore or any other wellbore component within the outside environment is decreased.

During movement of the piston away from the port due to the increased pressure within the outside environment exerting force on the hydrostatic side of the piston, the piston is moved away from the port and the volume of the sealed chamber is decreased and, therefore, becomes energized by compression of the fluid or gas contained in the sealed chamber. Conversely, when the hydrostatic pressure is decreased, the compressed fluid or gas in the sealed chamber exerts a force on the sealed side of the piston to force the piston back until equilibrium of pressure on both sides of the piston is established, or until the piston can no longer move, such as due to the piston reaching the top or bottom of the hydrostatic chamber. In other words, the atmospheric pressure or gas pressure within the sealed chamber acts as a return mechanism for the piston.

Similarly, during movement of the piston toward the port due to the decreased pressure within the outside environment reducing force on the hydrostatic side of the piston, the piston is moved toward the port and the volume of the sealed chamber is increased until the pressure on both sides of the piston is equalized, or until the piston can no longer move, such as due to the piston reaching the top or bottom of the hydrostatic chamber. When the hydrostatic pressure is increased, it exerts a force on the hydrostatic side of the piston to force the piston back until equilibrium of pressure on both sides of the piston is established, or until the piston can no longer move, such as due to the piston reaching the top or bottom of the sealed chamber.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
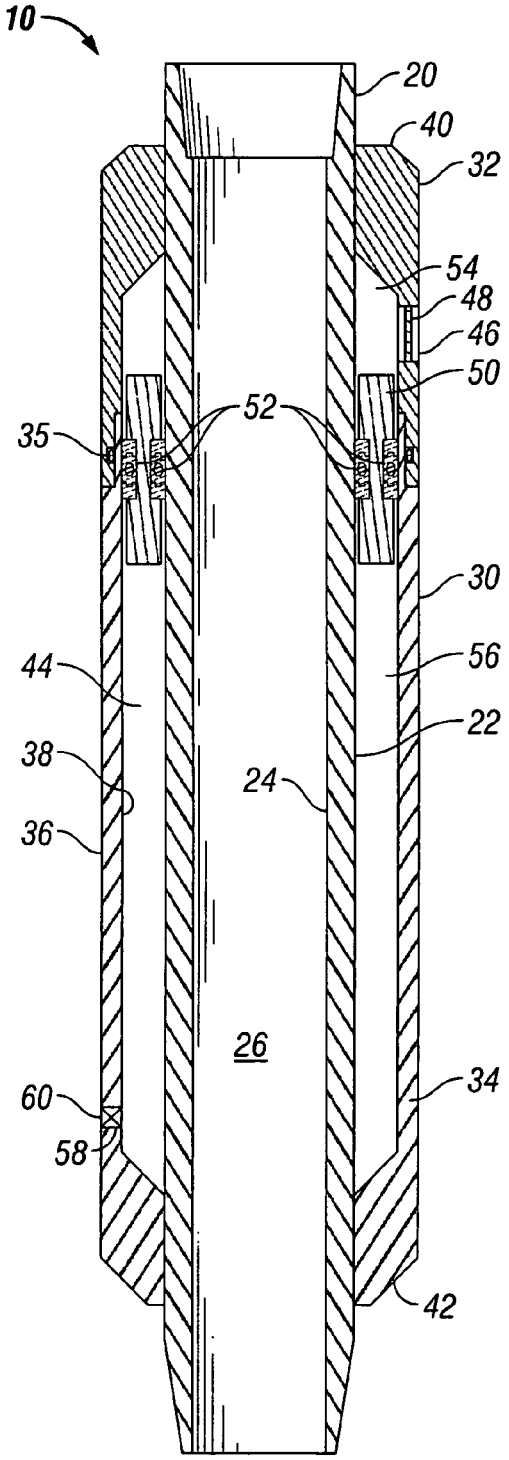
FIG. 1 is a cross-sectional view of one specific embodiment of a pressure relief device disclosed herein.

Referring now to FIG. 1, one specific embodiment of a pressure relief device 10 is shown. This embodiment of pressure relief device 10 comprises tubular member 20 having outer wall surface 22 and inner wall surface 24 defining bore 26. Disposed on outer wall surface 22 is housing 30. As shown in FIG. 1, housing 30 comprises upper housing portion 32 attached to lower housing portion 34. Seal 35 prevents fluid leaks between this connection. Although housing 30 is shown as having two components, it is to be understood, that housing 30 is not required to comprise upper and lower housing portions 32, 34, but instead may be formed by a single component, or more than two components. In addition, upper housing portion 32 may be connected to lower housing portion 34 through any device or method known in the art, such as reciprocal threads (not shown) disposed on upper and lower housing portions 32, 34.

Housing 30 includes outer wall surface 36 and inner wall surface 38, and is connected to outer wall surface 22 of tubular member 20 at upper and lower ends 40, 42. Chamber 44 is disposed between inner wall surface 38 of housing 30 and outer wall surface 22 of tubular member 20. Housing 30 also includes port 46 which is in fluid communication, or capable of being placed in fluid communication, with an outside environment such as the annulus of a wellbore (not shown in FIG. 1, but discussed with respect to FIGS. 2-8). For example, port 46 may be continuously opened such that fluid is permitted to flow into and out of chamber 44. Alternatively, a device such as rupture disc 48 or the like may be placed within port 46 such that fluid communication between chamber 44 and the outside environment is not established until a predetermined condition is met, such as a predetermined temperature or pressure.

Disposed within chamber 44 is piston 50. Piston 50 is in sliding engagement with outer wall surface 22 of housing 20 and inner wall surface 38 of housing 30. Seals 52 prevent fluid leaks between piston 50 and outer wall surface 22 of housing 20 and inner wall surface 38 of housing 30. Piston 50 divides chamber 44 into hydrostatic chamber 54 and sealed chamber 56. Hydrostatic chamber 54 is in fluid communication with port 46. Sealed chamber 56 is isolated from the outside environment except in certain embodiments where a charging port is provided for charging. "Charging" occurs when a gas, such as nitrogen, is pumped into sealed chamber 56 of chamber 44. As shown in the embodiment of FIG. 1, housing 30 includes charging port 58 that includes a fluid flow restriction device, shown as one-way check valve 60, disposed therein so that a gas source can be placed in fluid communication with one-way check valve 60 and gas can be forced through one-way check valve 60, and thus through port 58, and into sealed chamber 56 of chamber 44.

In one specific operation of pressure relief device 10, pressure relief device 10 is placed in a work string such as production string or other string of tubing (not shown in FIG. 1) and run-into a cased wellbore (not shown in FIG. 1). Pressure relief device 10 is then disposed within the cased wellbore at a location where the annulus of the wellbore is isolated from other parts of the wellbore. The isolation of the wellbore can be established by any method or device known in the art such as by use of one or more wellbore barriers such as packers, bridge plugs, valves, wellheads, the bottom of the wellbore, and the like. In so doing, either because port 46 is continuously opened or because rupture disc 48 or other similar device is actuated, hydrostatic chamber 54 of chamber 44 is placed in fluid communication with the isolated wellbore annulus. In the event that the fluid contained within the isolated wellbore annulus expands, or the pressure within the isolated wellbore annulus increases, such as due to production operations being performed through the work string, the increased pressure enters hydrostatic chamber 54 of chamber 44 and exerts force on piston 50. Piston 50 is then moved away from port 46 causing the volume of sealed chamber 56 of chamber 44 to decrease and the volume of hydrostatic chamber 54 to increase. As a result, the atmospheric pressure or gas within sealed chamber 56 becomes compressed or "energized." Piston 50 continues to move into sealed chamber 56 until the pressure on both sides of piston 50 reach equilibrium, or until piston 50 can no longer move away from port 46 such as due to piston 50 engaging a detent or stop (not shown). In so doing, the pressure being exerted on the inner wall of the casing, or the inner wall of the formation, or the outer wall surface of the work string, is spread out and lessened, which decreases the likelihood of failure of any of the casing, the formation, or the work string, or any other wellbore component disposed in the isolated wellbore annulus.

Thereafter, if the pressure within the isolated wellbore annulus decreases, such as due to a temperature decrease due to cessation of production operations through the work string, the compressed atmospheric pressure or gas within sealed chamber 56 exerts a force against piston 50 that is greater than the hydrostatic pressure within hydrostatic chamber 54. Accordingly, piston 50 moves toward port 46 causing the volume in hydrostatic chamber 54 of chamber 44 to decrease and the volume of sealed chamber 56 to increase. Piston 50 continues to move toward port 46, reducing the volume of hydrostatic chamber 54 and increasing the volume of sealed chamber 56 until the pressure on both sides of piston 50 reach equilibrium, or until piston 50 can no longer move toward port 46 such as due to piston 50 engaging a detent or stop (not shown). Thereafter, piston 50 is in position such that it can again move away from port 46 in response to a pressure increase within the isolated wellbore annulus.

In another embodiment of the operation of pressure relief device 10, the fluid within the isolated wellbore annulus contracts, or the pressure within the isolated wellbore annulus decreases, such as due to fluid injection operations being performed through the work string, the decreased pressure reduces the force being exerted on the hydrostatic side of piston 50. As a result, piston 50 is then moved toward port 46 causing the volume of sealed chamber 56 of chamber 44 to increase and the volume of hydrostatic chamber 54 to decrease. As a result, the atmospheric pressure or gas within sealed chamber 56 becomes "energized," i.e., biased away from port 46. Piston 50 continues to move into hydrostatic chamber 56 until the pressure on both sides of piston 50 reach equilibrium, or until piston 50 can no longer move toward port 46 such as due to piston 50 engaging a detent or stop (not shown). In so doing, the pressure being exerted on the inner wall of the casing, or the inner wall of the formation, or the outer wall surface of the work string, is spread out and increased toward or achieving equilibrium, which decreases the likelihood of failure of any of the casing, the formation, or the work string, or any other wellbore component disposed in the isolated wellbore annulus.

Thereafter, if the pressure within the isolated wellbore annulus increases, such as due to a temperature increase due to cessation of fluid injection operations through the work string, the "energized" sealed chamber 56 exerts a force on piston 50 that is greater than the hydrostatic pressure within hydrostatic chamber 54. Accordingly, piston 50 moves away from port 46 causing the volume in hydrostatic chamber 54 of chamber 44 to increase and the volume of sealed chamber 56 to decrease. Piston 50 continues to move away from port 46, increasing the volume of hydrostatic chamber 54 and decreasing the volume of sealed chamber 56 until the pressure on both sides of piston 50 reach equilibrium, or until piston 50 can no longer move away from port 46 such as due to piston 50 engaging a detent or stop (not shown). Thereafter, piston 50 is in position such that it can again move away from port 46 in response to a pressure decrease within the isolated wellbore annulus.

Figure 2:
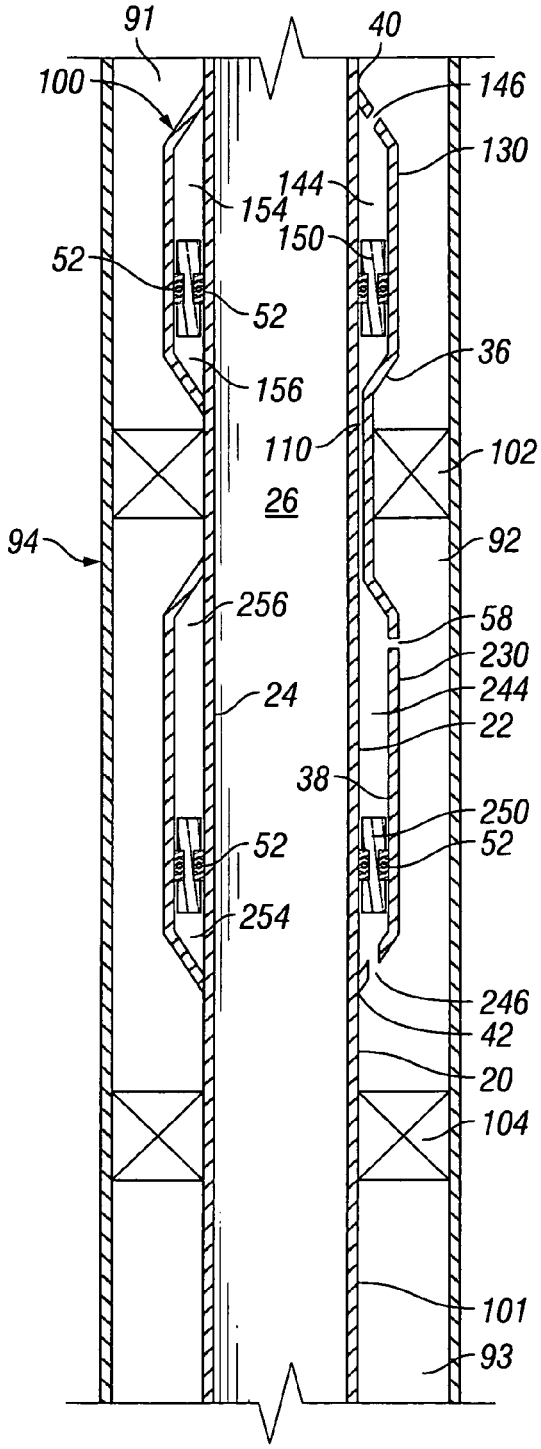
FIG. 2 is a cross-sectional view of another specific embodiment of a pressure relief device disclosed herein shown disposed within a wellbore.

Referring now to FIG. 2, in another specific embodiment, pressure relief device 100 comprises a tubular member 20 having outer wall surface 22 and inner wall surface 24 defining bore 26. Disposed on outer wall surface 22 are upper and lower housings 130, 230 connected to each other through passage 110. Passage 110 may be disposed completely circumferentially around tubular member 20 or, as shown in FIG. 2, partially circumferentially around tubular member 20.

Upper and lower housings 130, 230 include outer wall surface 36 and inner wall surface 38 and are connected to outer wall surface 22 of tubular member 20 at upper and lower ends 40, 42. Chambers 144, 244 are disposed between inner wall surface 38 of upper and lower housings 130, 230 and outer wall surface 22 of tubular member 20 and are connected to each other through passage 110. Upper and lower housings 130, 230 also include ports 146, 246, respectively, in fluid communication, or capable of being placed in fluid communication, with an outside environment such as annulus 91 and annulus 92, respectively, of wellbore 94. For example, as shown in the embodiment of FIG. 2, ports 146, 246 may be continuously opened such that fluid is permitted to flow into and out of chambers 144, 244, respectively. Alternatively, a device such as rupture disc or the like (not shown) may be placed within ports 146, 246 such that fluid communication between chambers 144, 244 and the outside environment is not established until a predetermine condition is met, such as a predetermined temperature or pressure.

Disposed within chamber 144 is piston 150 and disposed within chamber 244 is piston 250. Pistons 150, 250 are in sliding engagement with outer wall surface 22 of housing 20 and inner wall surface 38 of housings 130, 230, respectively. Seals 52 prevent fluid leaks between pistons 150, 250 and outer wall surface 22 of housing 20 and inner wall surface 38 of housings 130, 230, respectively. Pistons 150, 250 divide chambers 144, 244 into hydrostatic chambers 154, 254 and sealed chambers 156, 256, respectively. Hydrostatic chambers 154, 254 are in fluid communication with ports 146, 246, respectively. Sealed chambers 156, 256 are isolated from the outside environment except during charging. Sealed chambers 156, 256 are charged through charging port 58 which includes a fluid flow restriction device (not shown).

In one particular operation of pressure relief device 100, pressure relief device 100 is placed in work string 101 such as a production string or other string of tubing and run-into cased wellbore 94. Pressure relief device 100 is then disposed within cased wellbore 94 such that upper housing 130 is disposed above wellbore barrier 102 and lower housing 230 is disposed below wellbore barrier 102 and above wellbore barrier 104. Thus, hydrostatic chamber of piston 150 is placed in fluid communication with annulus 91 of wellbore 94 through port 146, and hydrostatic chamber of piston 250 is placed in fluid communication with annulus 92 of wellbore 94 through 246. In so doing, either because ports 146, 246 are continuously opened or because a rupture disc or other similar device is actuated, hydrostatic chambers 154, 254 are placed in fluid communication with the isolated wellbore annulus 91, 92, respectively.

After being disposed within wellbore 94, pressure relief device 100 can be actuated by increased hydrostatic pressure within one or both of annulus 91 or annulus 92 in the same manner as described above with respect to pressure relief device 10; however, movement of piston 250 toward port 146 of upper housing 130 will cause piston 150 to move in the same direction, and movement of piston 150 toward port 246 of lower housing 230 will cause piston 250 to move in the same direction. Thus, pressure relief device 100 is capable of providing reduction of pressure in two different isolated wellbore annuluses and, in so doing, balances the pressures within annuluses 91, 92.

In one specific operation of pressure relief device 100, pressure relief device 100, such as in the event that wellbore barrier 104 fails, the increase in pressure within annulus 92 caused by the pressure from annulus 93 combining with the pressure within annulus 92 will be distributed through port 246 into hydrostatic chamber 254, causing piston 250 to move away from port 246, i.e., upward in the embodiment of FIG. 2. In so doing, some of the pressure within annulus 92 is distributed through passage 110 into annulus 91 by movement of piston 150 toward port 146. The reduction of pressure within annulus 92 lessens the likelihood of wellbore barrier 102 failing.

Figure 3:
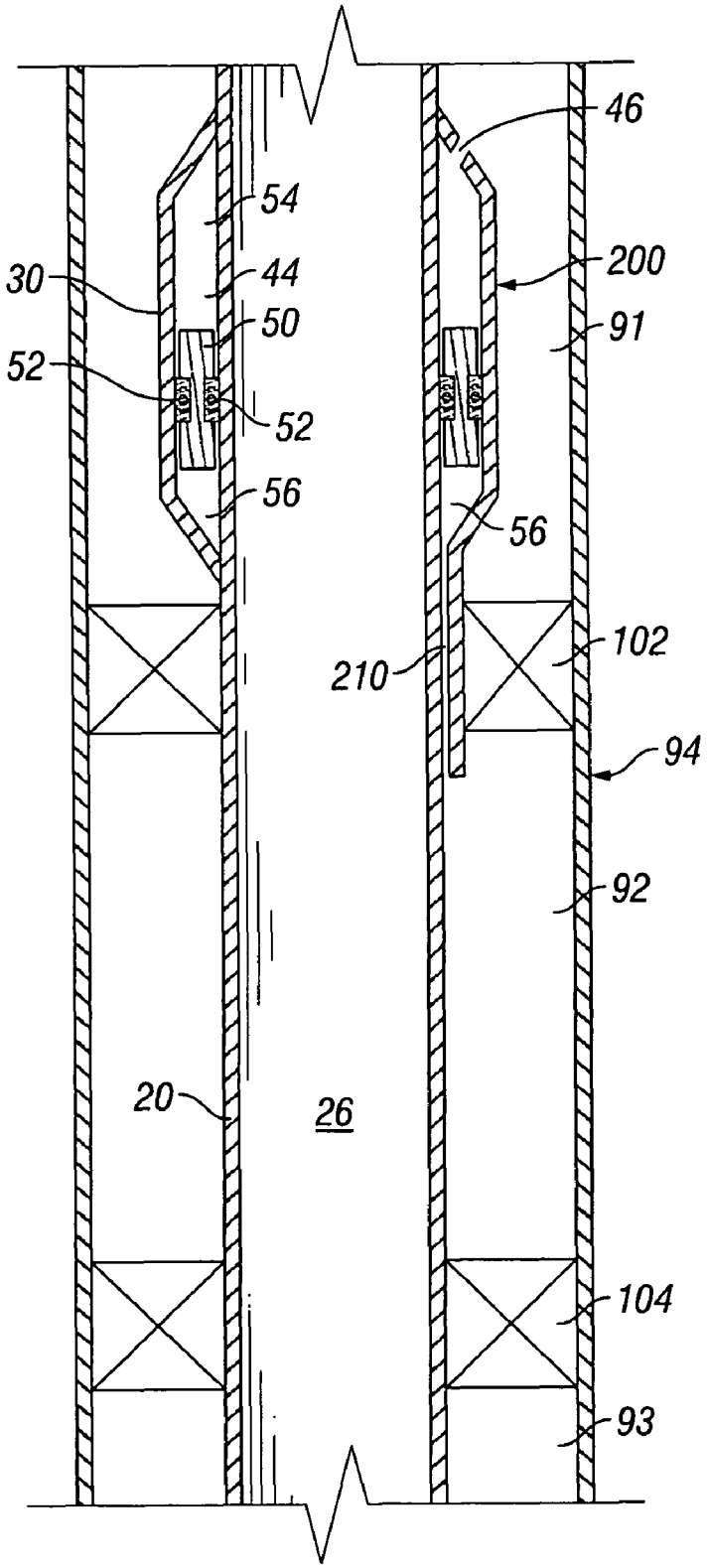
FIG. 3 is a cross-sectional view of an additional specific embodiment of a pressure relief device disclosed herein shown disposed within a wellbore.

Referring now to FIG. 3, in another embodiment, pressure relief device 200 comprises the same components as discussed above with respect to FIG. 1 with the addition of passage 210. Pressure relief device 200 is disposed above both wellbore barriers 102, 104. In this embodiment, sealed chamber 56 is in fluid communication with passage 210 which is in fluid communication with sealed annulus 92 through wellbore barrier 102. In this embodiment, should wellbore barrier 104 fail, the increase in pressure within annulus 92 caused by the pressure within annulus 93 combining with the pressure within annulus 92 will be distributed through passage 210 and into housing chamber 44, causing piston 50 to move toward port 46, i.e., upward in the embodiment of FIG. 3, relieving some of the pressure within annulus 92 and distributing it into annulus 91. The reduction of pressure within annulus 92 lessens the likelihood of wellbore barrier 102 failing.

Figure 4:
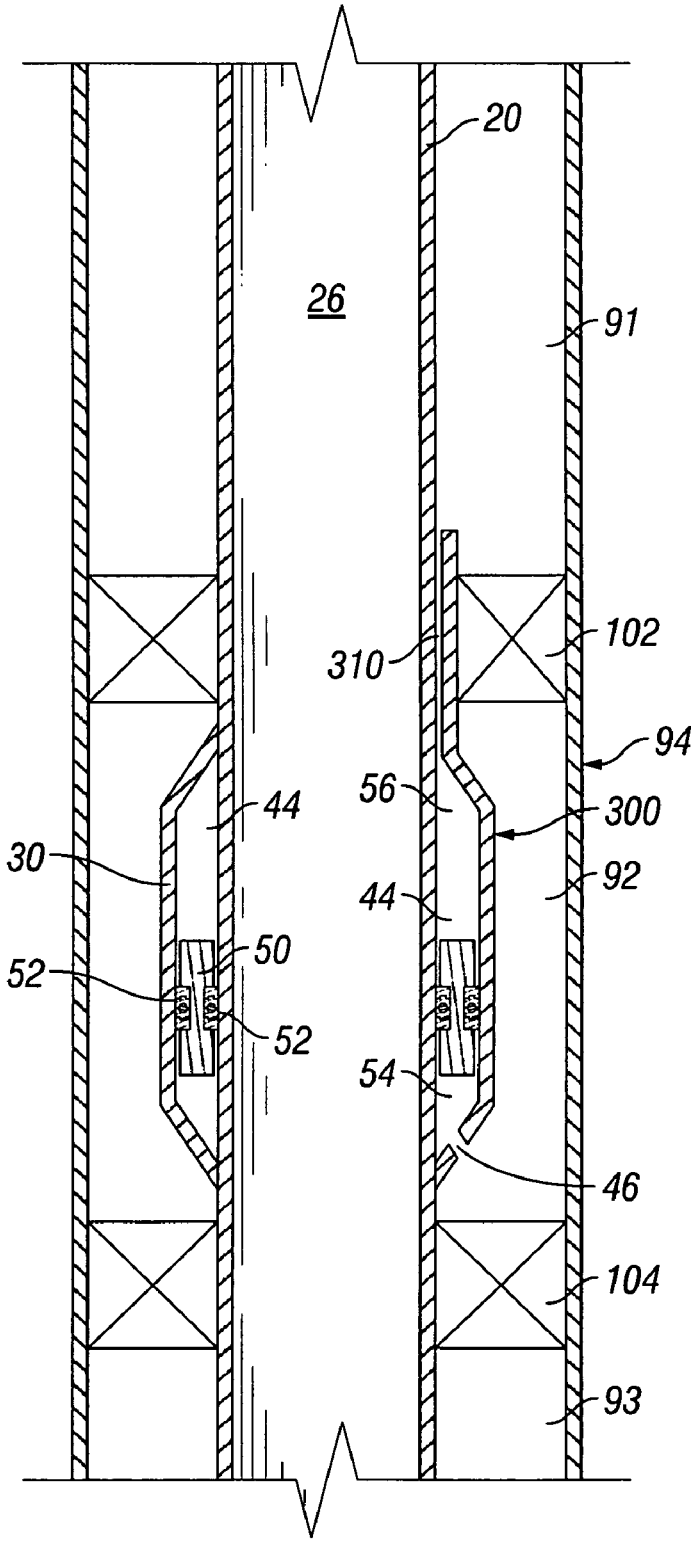
FIG. 4 is a cross-sectional view of still another specific embodiment of a pressure relief device disclosed herein shown disposed within a wellbore.

In another embodiment, shown in FIG. 4, pressure relief device 300 comprises the same components as discussed above with respect to FIG. 3 with the addition of passage 310 and with the modification of the location of pressure relief device 300 relative to wellbore barriers 102, 104. In this embodiment, pressure relief device 300 is disposed between wellbore barriers 102, 104 and sealed chamber 56 is in fluid communication with passage 310 which is in fluid communication with sealed annulus 91 through wellbore barrier 102. Thus, sealed chamber 56 is disposed above piston 50. In this embodiment, should wellbore barrier 104 fail, the increase in pressure within annulus 92 caused by the pressure within annulus 93 combining with the pressure within annulus 92 will be distributed through port 46 into hydrostatic chamber 54, causing piston 50 to move away from port 46, i.e., upward in the embodiment of FIG. 4. In so doing, some of the pressure within annulus 92 is distributed through passage 310 into annulus 91. The reduction of pressure within annulus 92 lessens the likelihood of wellbore barrier 102 failing.

Figure 5:
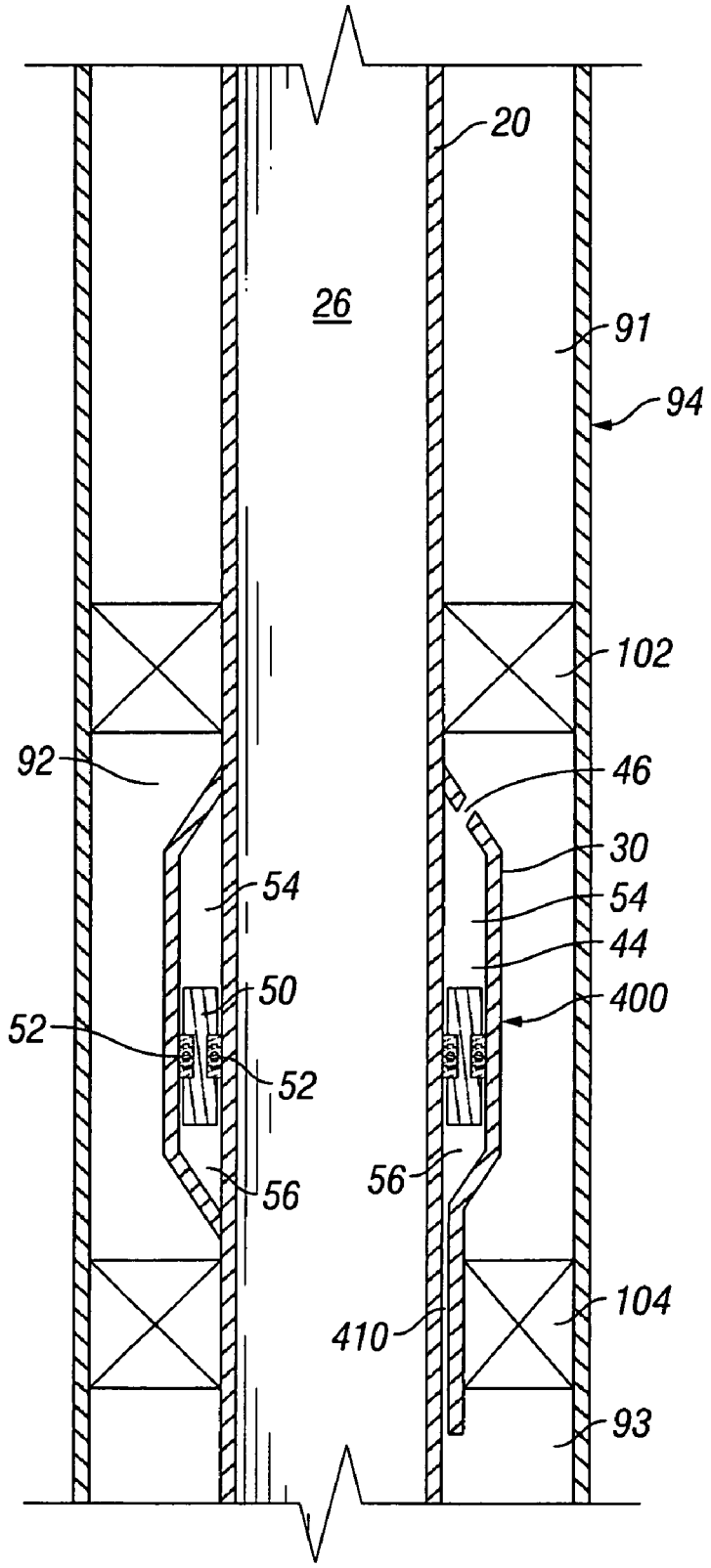
FIG. 5 is a cross-sectional view of yet another specific embodiment of a pressure relief device disclosed herein shown disposed within a wellbore.

As illustrated in FIG. 5, pressure relief device 400 comprises the same components as discussed above with respect to FIG. 3 with the modification of the location of pressure relief device 400 relative to wellbore barriers 102, 104. In this embodiment, pressure relief device 400 is disposed between wellbore barriers 102, 194 with sealed chamber 56 in fluid communication with passage 410 which is in fluid communication with sealed annulus 93 through wellbore barrier 104. In this embodiment, should wellbore barrier 102 fail, the increase in pressure within annulus 92 caused by the pressure within annulus 91 combining with the pressure within annulus 92 will be distributed through port 46 into hydrostatic chamber 56 causing piston 50 to move away from port 46, i.e., downward in the embodiment of FIG. 5. In so doing, some of the pressure within annulus 92 is distributed through passage 410 into annulus 93. The reduction of pressure within annulus 92 lessens the likelihood of wellbore barrier 104 failing.

Figure 6:
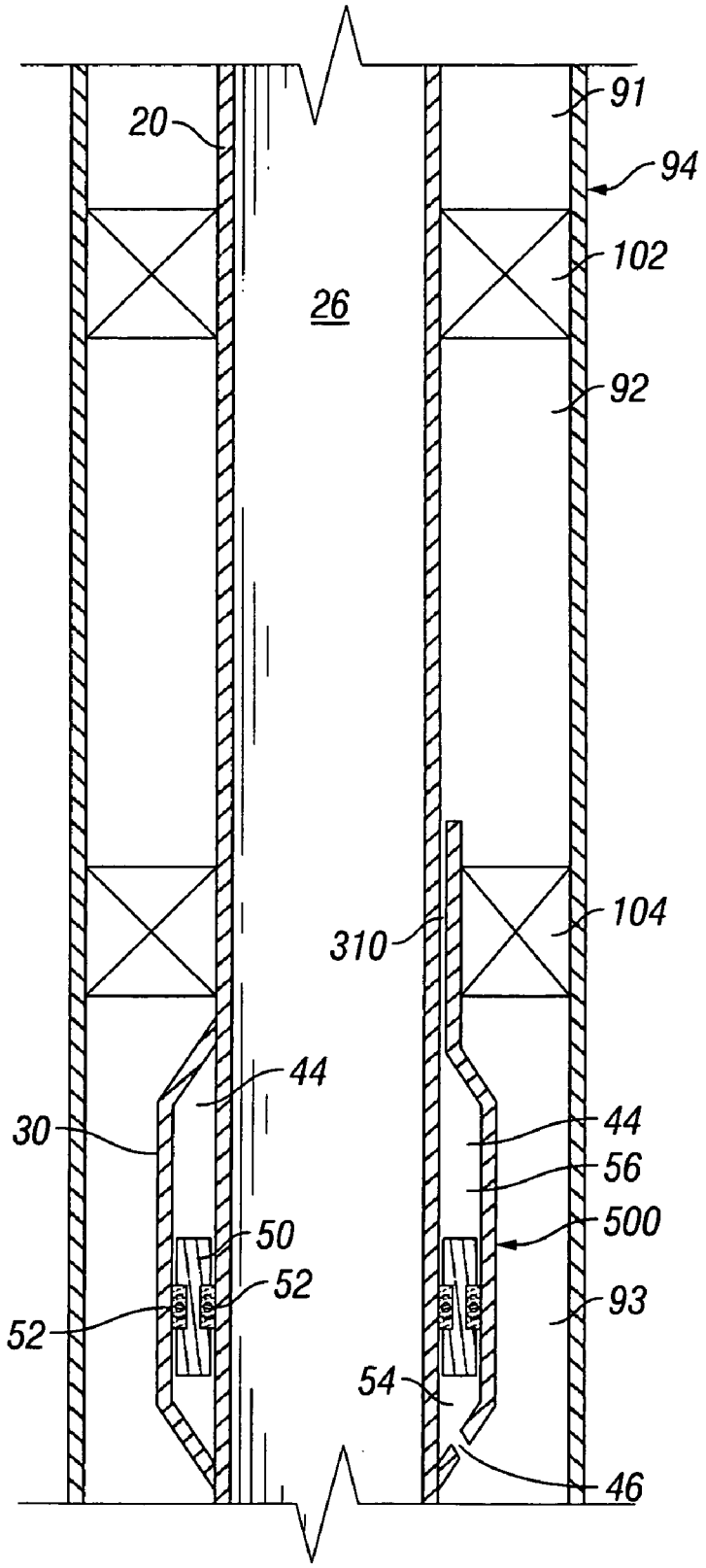
FIG. 6 is a cross-sectional view of an additional specific embodiment of a pressure relief device disclosed herein shown disposed within a wellbore.

In another embodiment, shown in FIG. 6, pressure relief device 500 comprises the same components as discussed above with respect to FIG. 4, with the modification of the location of pressure relief device 500 relative to wellbore barriers 102, 104. In this embodiment, pressure relief device 500 is disposed below both wellbore barriers 102, 104 with sealed chamber 56 being in fluid communication with passage 310 which is in fluid communication with sealed annulus 92 through wellbore barrier 104. Thus, sealed chamber 56 is disposed above piston 50. In this embodiment, should pressure within annulus 93 increase, the increase in pressure within annulus 93 will be distributed through port 46 into hydrostatic chamber 54, causing piston 50 to move away from port 46, i.e., upward in the embodiment of FIG. 6. In so doing, some of the pressure within annulus 93 is distributed through passage 310 into annulus 92. The reduction of pressure within annulus 93 lessens the likelihood of wellbore barrier 104 failing.

Figure 7:
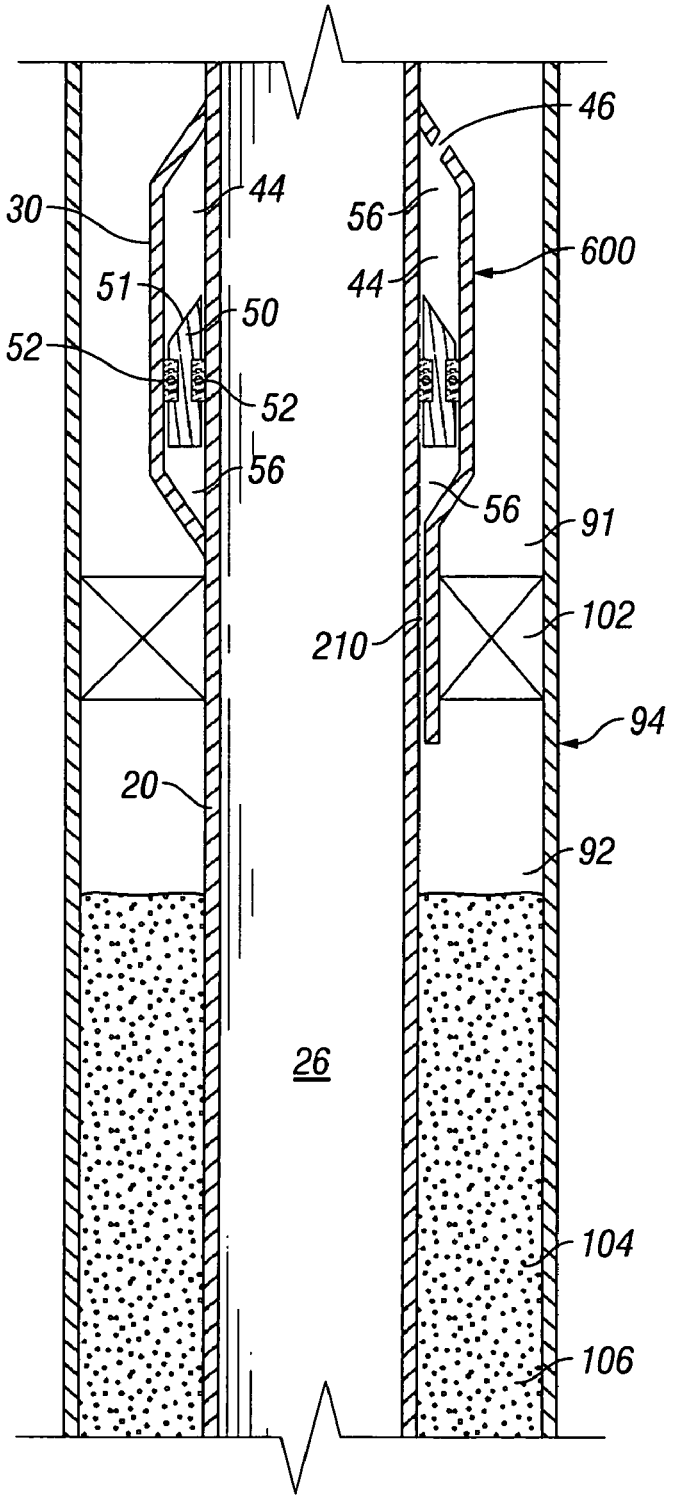
FIG. 7 is a cross-sectional view of still another specific embodiment of a pressure relief device disclosed herein shown disposed within a wellbore.

Referring now to FIG. 7, in another embodiment, pressure relief device 600 comprises the same components as discussed above with respect to FIG. 3 with the modification of the location of pressure relief device 600 relative to wellbore barrier 102, 104 and wherein wellbore barrier 104 is shown as cement plug 106. As shown in FIG. 7, pressure relief device 600 is disposed above both wellbore barriers 102, 104. In addition, piston 50 comprises face seal 51. In this embodiment, as the cement sets to form cement plug 106, the volume loss within annulus 92 is compensated by movement of piston 50 toward port 46, i.e., upward in the embodiment of FIG. 7. In other words, the increased pressure within annulus 92 is distributed through passage 210 into sealed chamber 56 causing piston 50 to move toward port 46 thereby increasing the pressure within hydrostatic chamber 56 and, thus, annulus 91. In so doing, some of the pressure within annulus 92 is decreased thereby lessening the likelihood of wellbore barrier 102 failing. In addition, face seal 51 facilitates creation of a seal with port 46 to reduce the possibility of leakage occurring through port 46 so that a certain pressure can be maintained within sealed chamber 56 and, thus, annulus 92.

Figure 8:
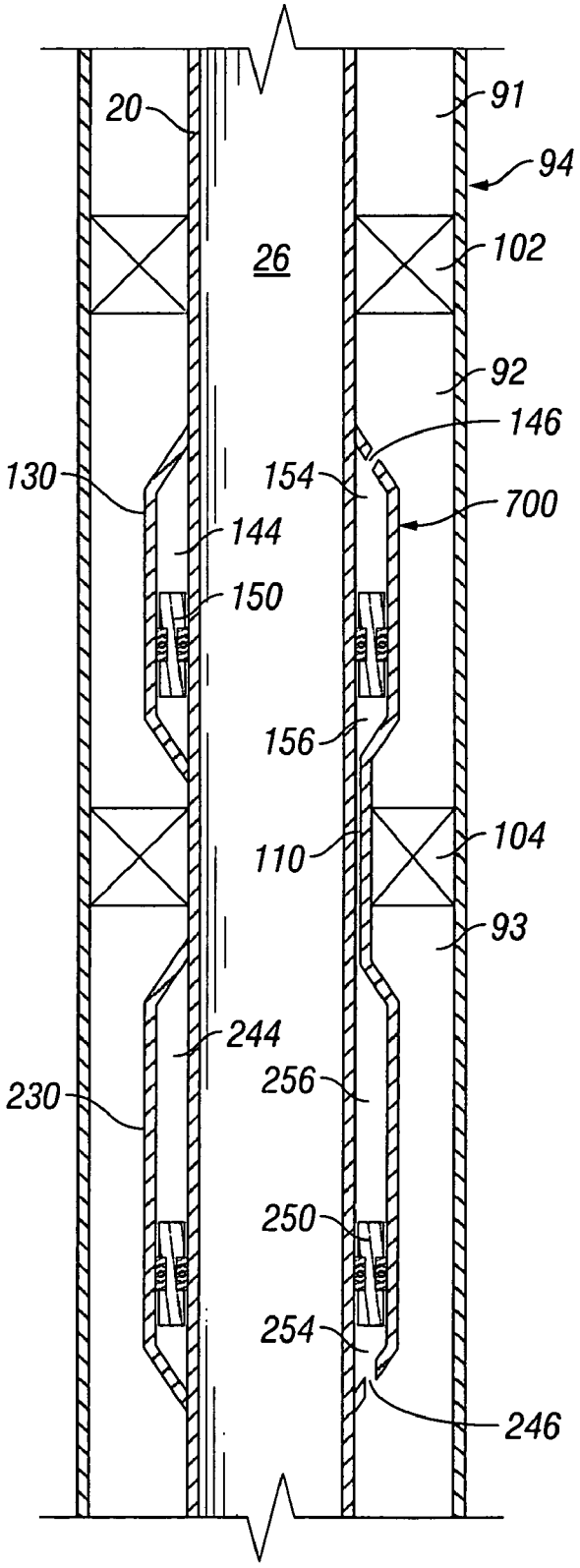
FIG. 8 is a cross-sectional view of yet another specific embodiment of a pressure relief device disclosed herein shown disposed within a wellbore.

In still another embodiment, shown in FIG. 8, pressure relief device 700 comprises the same components as discussed above with respect to FIG. 2 with the modification of the location of pressure relief device 700 relative to wellbore barriers 102, 104. In this embodiment, pressure relief device 700 is disposed such that upper housing 130 is disposed between wellbore barriers 102, 104 and lower housing 230 is disposed below wellbore barrier 104. In this embodiment, should wellbore barrier 102 fail, the increase in pressure within annulus 92 caused by the combination of the pressure from annulus 91 with the pressure within annulus 92 will be distributed through port 146 into hydrostatic chamber 154, causing piston 150 to move away from port 146, i.e., downward in the embodiment of FIG. 8. In so doing, some of the pressure within annulus 92 is distributed through passage 110 into annulus 93 by movement of piston 250 toward port 246. The reduction of pressure within annulus 92 lessens the likelihood of wellbore barrier 104 failing.

It is to be understood that the invention is not limited to the exact details of construction, operation, exact materials, or embodiments shown and described, as modifications and equivalents will be apparent to one skilled in the art. For example, the passages in the various embodiments of the pressure relief devices, if present, may be as shown or may be disposed completely around the circumference of the tubular member 20. Moreover, the sealed chambers of the pressure relief devices are not required to be charged with a gas before use. Instead, sealed chambers may be atmospheric chambers such that no charging ports are required. In addition, the pistons may be differential pistons to compensate for the pressure differences within the hydrostatic chambers and the sealed chambers. Further, the housing chamber may be disposed above, below, or in between the upper or lower wellbore barriers. Additionally, the pressure relief device may be disposed between the bottom of the wellbore and another wellbore barrier such as a packer. Moreover, the passages may extend through two or more wellbore barriers to reach different isolated wellbore annuluses. Further, three or more pressure relief devices may be disposed within a wellbore and they may or may not include passages establishing fluid communication with the sealed chambers of each of the pressure relief devices. In addition, in embodiments comprising two or more housing chambers, each housing chamber is not required to contain a piston. For example, in the embodiment of FIGS. 2 and 8, the upper or lower piston may be removed and the pressure relief device will still function to reduce pressure within an isolated outside environment, e.g., an isolated wellbore annulus, of the wellbore. Additionally, the pressure relief devices disclosed herein can be used in circumstances in which the pressure within the wellbore annulus increases or decreases. Accordingly, the invention is therefore to be limited only by the scope of the appended claims.

What is claimed is:

1. A pressure relief device for compensating for a change in pressure within an isolated outside environment within a wellbore, the pressure relief device comprising:

a tubular member having an outer wall surface and an inner wall surface defining a bore;

a housing disposed on the outer wall surface of the tubular member, the housing having a port and an inner wall surface defining a housing chamber;

a piston disposed within the housing chamber, the piston being in sliding engagement with the outer wall surface of the tubular member and the inner wall surface of the housing chamber defining a hydrostatic chamber and a sealed chamber within the housing chamber, the port being in fluid communication with the hydrostatic chamber;

an upper wellbore barrier operatively associated with the tubular member;

a lower wellbore barrier operatively associated with the tubular member, the lower wellbore barrier being disposed below the upper wellbore barrier; and a passage in fluid communication with the sealed chamber, the passage providing fluid communication through the upper wellbore barrier, wherein the piston moves within the housing chamber due to a change in pressure within an isolated outside environment.

2. The pressure relief device of claim 1, wherein the housing chamber is disposed above the upper wellbore barrier.

3. The pressure relief device of claim 2, wherein the lower wellbore barrier comprises a cement plug.

4. The pressure relief device of claim 1, wherein the housing chamber is disposed between the upper wellbore barrier and the lower wellbore barrier.

5. The pressure relief device of claim 1, wherein the piston comprises a seal face disposed on a hydrostatic side of the piston.

6. The pressure relief device of claim 1, wherein the housing chamber further comprises a charging port in fluid communication with the sealed chamber, the charging port having a fluid flow restriction device disposed therein.

7. The pressure relief device of claim 6, wherein the fluid flow restriction device is a one-way check valve.

8. The pressure relief device of claim 7, wherein the sealed chamber comprises a gas.

9. A pressure relief device for compensating for a change in pressure within an isolated outside environment within a wellbore, the pressure relief device comprising:

a tubular member having an outer wall surface and an inner wall surface defining a bore;

a housing disposed on the outer wall surface of the tubular member, the housing having a port and an inner wall surface defining a housing chamber;

a piston disposed within the housing chamber, the piston being in sliding engagement with the outer wall surface of the tubular member and the inner wall surface of the housing chamber defining a hydrostatic chamber and a sealed chamber within the housing chamber, the port being in fluid communication with the hydrostatic chamber;

an upper wellbore barrier operatively associated with the tubular member;

a lower wellbore barrier operatively associated with the tubular member, the lower wellbore barrier being disposed below the upper wellbore barrier; and a passage in fluid communication with the sealed chamber, the passage providing fluid communication through the lower wellbore barrier, wherein the piston moves within the housing chamber due to a change in pressure within an isolated outside environment.

10. The pressure relief device of claim 9, wherein the housing chamber is disposed between the upper wellbore barrier and the lower wellbore barrier.

11. The pressure relief device of claim 9, wherein the housing chamber is disposed below the lower wellbore barrier.

12. A pressure relief device for compensating for a change in pressure within an isolated outside environment within a wellbore, the pressure relief device comprising:

a tubular member having an outer wall surface and an inner wall surface defining a bore;

an upper housing disposed on the outer wall surface of the tubular member, the upper housing having an upper housing port and an inner wall surface defining an upper housing chamber;

an upper piston disposed within the upper housing chamber, the upper piston being in sliding engagement with the outer wall surface of the tubular member and the inner wall surface of the upper housing chamber defining an upper hydrostatic chamber and an upper sealed chamber within the upper housing chamber, the upper housing port being in fluid communication with the upper hydrostatic chamber;

a lower housing disposed on the outer wall surface of the tubular member, the lower housing having a lower housing port and an inner wall surface defining a lower housing chamber;

a lower piston disposed within the lower housing chamber, the lower piston being in sliding engagement with the outer wall surface of the tubular member and the inner wall surface of the lower housing chamber defining a lower hydrostatic chamber and a lower sealed chamber within the lower housing chamber, the lower housing port being in fluid communication with the lower hydrostatic chamber, and the upper sealed chamber being in fluid communication with the lower sealed chamber;

a first wellbore barrier operatively associated with the tubular member; and a second wellbore barrier operatively associated with the tubular member, the second wellbore barrier being disposed below the first wellbore barrier, wherein the upper and lower pistons move respectively within the upper and lower housing chambers due to a change in pressure within an isolated outside environment.

13. The pressure relief device of claim 12, wherein a charging port is in fluid communication with the upper and lower sealed chambers, the charging port comprising a fluid flow restriction device disposed therein, and wherein a gas is disposed within the upper and lower sealed chambers.

14. The pressure relief device of claim 12, wherein the upper sealed chamber is in fluid communication with the lower sealed chamber through a passage disposed through the upper wellbore barrier.

15. The pressure relief device of claim 14, wherein the passage is disposed partially circumferential around the outer wall surface of the tubular member and is partially formed by extensions of the inner wall surfaces of the upper and lower housings.

16. The pressure relief device of claim 12, wherein the upper sealed chamber is in fluid communication with the lower sealed chamber through a passage disposed through the lower wellbore barrier.

17. A method of reducing pressure within an isolated wellbore annulus, the method comprising the steps of:

(a) providing a wellbore;

(b) disposing a tubular string within the wellbore, the tubular string comprising a tubular member having a housing disposed on an outer wall surface of the tubular member, the housing having a port and an inner wall surface defining a housing chamber, a piston disposed within the housing chamber, the piston being in sliding engagement with the outer wall surface of the tubular member and the inner wall surface of the housing chamber defining a hydrostatic chamber and a sealed chamber within the housing chamber, the port being in fluid communication with the hydrostatic chamber, a first wellbore barrier operatively associated with the tubular member, a second wellbore barrier operatively associated with the tubular member, the second wellbore barrier being disposed below the first wellbore barrier, and a passage in fluid communication with the sealed chamber, the passage providing fluid communication through the first wellbore barrier;

(c) establishing an isolated wellbore annulus with the first and second wellbore barriers, the port being in fluid communication with the isolated wellbore annulus;

(d) moving the piston away from the port due to an increase in pressure within the isolated wellbore annulus causing the sealed chamber to have a reduced volume, thereby reducing pressure within the isolated wellbore annulus and causing fluid to flow from the sealed chamber and through the passage through the first wellbore barrier.

18. The method of claim 17, further comprising the step of:

(e) moving the piston toward the port due to a decrease in pressure within the isolated wellbore annulus.

19. The method of claim 18, wherein step (e) is facilitated by a compressed gas contained within the sealed chamber.

20. The method of claim 18, wherein step (e) is facilitated by atmospheric pressure contained within the sealed chamber.

21. A method of increasing pressure within an isolated wellbore annulus, the method comprising the steps of:

(a) providing a wellbore;

(b) disposing a tubular string within the wellbore, the tubular string comprising a tubular member having a housing disposed on an outer wall surface of the tubular member, the housing having a port and an inner wall surface defining a housing chamber, a piston disposed within the housing chamber, the piston being in sliding engagement with the outer wall surface of the tubular member and the inner wall surface of the housing chamber defining a hydrostatic chamber and a sealed chamber within the housing chamber, the port being in fluid communication with the hydrostatic chamber, a first wellbore barrier operatively associated with the tubular member, a second wellbore barrier operatively associated with the tubular member, the second wellbore barrier being disposed below the first wellbore barrier, and a passage in fluid communication with the sealed chamber, the passage providing fluid communication through the second wellbore barrier;

(c) establishing an isolated wellbore annulus with the first and second wellbore barriers, the port being in fluid communication with the isolated wellbore annulus;

(d) moving the piston toward the port due to an increase in pressure within the isolated wellbore annulus causing the sealed chamber to have a reduced volume, thereby reducing pressure within the isolated wellbore annulus and causing fluid to flow from the sealed chamber and through the passage through the first wellbore barrier.

* * * * *